US005540749A

United States Patent [19]

Li et al.

[11] Patent Number: 5,540,749

[45] Date of Patent: Jul. 30, 1996

[54] PRODUCTION OF SPHERICAL BISMUTH SHOT

[75] Inventors: Taie Li, Lakewood; David E. Sanger; Duane M. Yantorno, Littleton, all of Colo.

[73] Assignee: Asarco Incorporated, New York, N.Y.

[21] Appl. No.: 303,306

[22] Filed: Sep. 8, 1994

[51] Int. Cl.[6] ..... B22F 9/06

[52] U.S. Cl. ..... 75/340; 102/448; 264/8; 425/8

[58] Field of Search ..... 75/340; 102/448; 264/8; 425/8

[56] References Cited

U.S. PATENT DOCUMENTS

| | | | |
|---|---|---|---|
| 204,298 | 5/1978 | Crooke . | |
| 4,383,853 | 5/1983 | Zapffe | 75/122.7 |
| 4,428,295 | 1/1984 | Urs | 102/448 |
| 4,714,023 | 12/1987 | Brown | 102/516 |
| 4,949,644 | 8/1990 | Brown | 102/498 |

FOREIGN PATENT DOCUMENTS

| | | | |
|---|---|---|---|
| 19305 | 2/1982 | Japan | 75/340 |

OTHER PUBLICATIONS

Shapes And Velocities of Bubbles Rising In Infinite liquids J. R. Grace,, Trans. Instn. Chem. Engrs, vol. 51, 1973.

Shapes And Velocities Of Single Drops And Bubbles Moving Freely Through Immiscible Liquids, J. R. Grace, T. Wairegi, T. H. Nguyen, Trans. Instn. Chem. Engrs., vol. 54, 1976.

Shape Of Liquid Drops Moving In Liquid Media, R. M. Wellek, A. K. Agrawal A.I.Ch.E. Journal, Sep., 1966.

Handbook Of Fluids In Motion, Nicholas P. Cheremisinoff, Ramesh Gupta Ann Arbor Science, The Butterworth Group.

*Primary Examiner*—Melvyn Andrews

*Attorney, Agent, or Firm*—DeLio & Peterson

[57] ABSTRACT

A method is provided for producing bismuth and bismuth alloy shot particles by a procedure whereby molten bismuth at a temperature less than about 100° C. above the melting point of the bismuth is used to form drops of molten bismuth which fall through a vessel containing a material more viscous than water with the method having a Reynolds Number less than about 100. Preferred materials are polyethylene glycols having a molecular weight of about 4500 and 8000.

22 Claims, No Drawings

PRODUCTION OF SPHERICAL BISMUTH SHOT

BACKGROUND OF THE INVENTION

1. Field of the Invention

This invention relates to environmentally safe non-toxic bismuth shot pellets used in shotgun shells and, in particular, to a process for producing said shot pellets.

2. Description of Related Art

Shotgun shells generally comprise a cylindrical casing enclosing an explosive charge and a plurality of spherical metal pellets. The density of the pellets and spherical shape is particularly important to sportsman such as hunters and trap shooters because of their ballistic qualities.

Metallic lead has been the material of choice over the years for shotgun pellets since it has the necessary characteristics needed to provide pellets of superior quality and performance. Lead shot is toxic however, and the toxic effects of lead upon the systems of live waterfowl, whether from non-lethal injury or ingestion during feeding, have prompted laws restricting the use of lead. Lead shot has already been banned in hunting waterfowl on federal lands and because of these restrictions and the probable complete ban on the use of lead in the future, non-toxic alternatives to lead have been proposed.

An early patent, U.S. Pat. No. 204,298, provides a tin plated lead shot which is unsatisfactory as a substitute because lead is still the base metal used and would eventually cause an environmental problem. U.S. Pat. No. 4,428,925 shows a high density shot made by cold-compaction of lead and a dense metal such as tungsten which has a longer effective target range than lead shot, but is unsatisfactory since lead is still used in the shot. Nickel and other coatings on lead by electrodeposition and other techniques also suffer from the same problem that lead is part of the shot and that the coatings would be eventually removed either by the abrasive action of the bird's gizzard or other abrasive or chemical action and the detrimental effect of the lead eventually realized. Even so called non-toxic electroless nickel plated lead shot as in U.S. Pat. No. 4,714,023 would probably be banned under new laws in this area because lead is the base metal of the shot.

Iron and steel shot are non-toxic and have been used but are ballistically inferior to lead and damage shotgun barrels. To improve the density of the steel shot and improve its ballistics, it has been proposed to form steel alloys with dense materials such as a uranium-chromium-steel shot as shown in U.S. Pat. No. 4,383,853. The use of alloying materials such as chromium and uranium present manufacturing and other environmental problems and are not particularly desirable from an industry standpoint.

Spherical lead shot is formed by pouring molten lead, usually containing elements such as antimony and arsenic, through a sieve at the top of a 125 foot tower. The molten alloy, while dropping, forms a true sphere before solidifying near the bottom of its fall. The shot is collected in water, rinsed, dried and sorted for size and sphericity. Other methods to produce lead shot, such as use of the Bleimeister machine, shoots lead through a perforated disk into water.

A recent patent to Brown, U.S. Pat. No. 4,949,644, provides non-toxic wildlife shot pellets for shotgun shells formed from bismuth or bismuth alloys. Bismuth is claimed to be a suitable substitute for lead and can be used in any useful spherical size, for example, BBB to dust size, and it is stated can be formed by casting, spin molding, dropping and punching. Unfortunately, the production of bismuth shot is not as straight forward as the production of lead shot and different and improved manufacturing procedures have to be developed to provide a process for the efficient manufacture of spherical bismuth shot.

It has been found that bismuth shot cannot be effectively produced using the prior art lead processes and it is accordingly an object of the present invention to provide a method for the production of bismuth or bismuth alloy shot.

It is another object of the present invention to provide as an article of manufacture spherical bismuth or bismuth alloy shot.

It is yet another object of the invention to provide essentially spherical bismuth or bismuth alloy shot which may be formed into spherical bismuth shot.

Other objects and advantages of the present invention will be readily apparent from the following description.

SUMMARY OF THE INVENTION

To produce essentially spherical and/or substantially spherical bismuth and bismuth alloy particles by forming molten bismuth shapes, e.g., drops, which are solidified in a liquid, it has been found necessary to closely control certain process parameters. For convenience the term "bismuth" refers to bismuth metal and bismuth alloys containing greater than 50% by weight bismuth and usually greater than 90% and 95%. Likewise, the term "essentially spherical" means particles which are spherical but slightly elliptical or teardrop and which may be used for shotgun shells but are not preferred. The terms "substantially spherical" and "spherical" may be used interchangeably and mean particles which are mostly spherical in shape and preferred for use in shotgun shells.

It has been discovered that it is important to form the molten bismuth drops from bismuth having a low amount of superheat with the temperature of the molten bismuth being less than about 100° C., preferably less than about 50° C. and most preferably less than about 25° C. above the melting point of the bismuth. Another important aspect of the invention is to control the process to provide Reynolds Numbers which fall within certain values. The Reynolds Number is defined as follows:

$$Re = \frac{\rho_c d_e U_D}{\mu_c}$$

wherein $\rho_c$=density of the liquid medium in the column;

$d_e$=volume-equivalent drop diameter;

$U_D$=terminal velocity of the drop; and $\mu_c$=viscosity of liquid medium in the column.

Reynolds Numbers have been used to predict the shape of a liquid drop moving in a liquid continuous phase and it has been surprisingly found that bismuth shot from essentially spherical to spherical can be formed by solidfication of molten bismuth drops in a liquid medium by correlating the Reynolds Number and the amount of superheat of the bismuth metal. It is theorized in liquid-liquid systems that the shape of the drop is dependent upon the balance between the fluid dynamic pressure exerted because of the relative velocity of the drop and continuous fluid and the interfacial forces which tend to make the drop a sphere. Control of the superheat and Reynolds Numbers for the bismuth liquid-bismuth metal—liquid continuous phase system at a value below about 100 preferably below about 10, e.g., 5 and 1, provides an essentially spherical to spherical bismuth shot particle.

Another value which is preferred to control is the Eötvös Number which is defined as follows:

$$E_0 = \frac{\Delta \rho g d_e}{\sigma}$$

wherein $\Delta\rho = |\rho_c - \rho_d|$ $\rho_d$=density of bismuth;

g=acceleration of gravity $\sigma$=interfacial tension

In general, the process will be controlled to provide Eotvos Numbers which will be in the range of about 0.01 to 1000, with a range of about 0.1 to 100 and 0.5 to 10–50 being preferred.

Broadly stated, it has been found that a method for producing essentially spherical and/or spherical bismuth and bismuth alloy particles (shot) comprises:

melting the bismuth material to a temperature less than about 100° C. above the melting point of the bismuth or bismuth alloy;

introducing the molten bismuth as drops into a vessel containing a liquid material, the Reynolds Number for the method being less than about 100; the height of the vessel being sufficient to allow the bismuth drops to solidify to their final shape before reaching the bottom of the vessel; and removing the solidified bismuth from the vessel.

The vessel is any suitable tank or container having a height sufficient to allow time for the bismuth to solidify to its final form before reaching the bottom of the vessel.

As is well known in the art, a suitable vessel is usually a column having container holding means at the top of the column above the height of the liquid in the column said container holding the molten bismuth and forming drops of bismuth by the bismuth falling through holes in the holding container. The drops fall into the column and fall by gravity through the liquid in the column to the bottom of the column. During the fall in the column, the drops contact the liquid medium in the column and depending on the operating parameters form an essentially spherical or substantially spherical shape, solidify and are then removed from the bottom of the column as bismuth shot product. It is preferred that the liquid medium be at an elevated temperature which may vary widely, e.g., up to boiling, preferably to at temperature about 10° C. or more below the boiling temperature. In a preferred embodiment of the invention, the temperature of the molten bismuth is less than about 50° C., and preferably less than about 25° C., above the melting point of the bismuth or the bismuth alloy. In the most preferred embodiment, the temperature of the molten bismuth is less than about 10° C. above the melting point of the bismuth. A preferred material for use in the column because of its demonstrated effectiveness is a room temperature solid polyethylene glycol having a molecular weight about 4500 and above. The temperature of the polyethylene glycol in the column is sufficient to melt the glycol and may vary widely and is preferably in the range of about 80° C. to about 100° C. The column may be any height up to 100 feet or more, with the height being sufficient to allow the bismuth to solidify to its final form before reaching the bottom of the column. Usually a height of about 13 feet high or less or even about 4 feet high or less since it has been found that using both such columns under the conditions mentioned above produce bismuth or bismuth alloy shot in an efficient manner.

DESCRIPTION OF THE PREFERRED EMBODIMENTS

Bismuth metal or any suitable bismuth alloy may be used in the method of the invention. It is a preferred feature of the invention that high surface tension alloying ingredients, especially those which are non-toxic, be used in amounts up to about 5% or more by weight to increase the surface tension of the bismuth alloy to be shotted. A particularly preferred bismuth alloy because of its demonstrated effectiveness comprises, by weight, about 98% bismuth, and 2% tin plus minor amounts of incidental impurities. The U.S. Fish and Wildlife Service is expected to approve an alloy containing, by weight, about 97% bismuth, 3% tin and incidental impurities and this alloy is another preferred alloy for use in the method of the invention. Suitable bismuth alloying ingredients include iron, copper, antimony and tungsten.

The bismuth is melted to a temperature less than about 100° C. above the melting point of the metal and preferably less than about 50° C., e.g., 10° C., above the melting point of the metal. A preferred temperature range for the 98% bismuth, 2% tin alloy is less than about 370° C., preferably 310° C., most preferably between the melting point and 290° C. The melting point of the alloy is about 260°–270° C. Similar temperatures would apply for the 97% bismuth, 3% tin alloy.

The molten bismuth alloy is transferred to a holding container situated above the shotting column. A plurality of holes in the holding container produces drops of molten bismuth metal which fall into the column and fall by gravity to the bottom of the column. Heaters and or coolers, may be employed in the container or delivery system to closely control the temperature of the bismuth. It is preferred that the drops not fall more than about 3 inches from the holding container to the liquid. It is also preferred that a constant head of metal be maintained in the holding container to provide drops of a uniform size. During the fall of the molten metal in the liquid, the metal takes on a final solid essentially or substantially spherical shape and is solidified.

It is preferred that materials substantially more viscous than water be used as the liquid medium in the shotting column and have a viscosity greater than about 0.03 poise measured at 100° C. Preferred materials are the polyethylene glycols having a molecular weight above about 200, preferably above 900 to about 8000, or more. The preferred material is Dow Chemical E4500 (PEG-100) which is a wax having a molecular weight of about 4500 and a freezing point of approximately 58° C. The material has a specific gravity of 1.2 at 25° C. It is preferred that the temperature of the wax be maintained about 80° C. to about 100° C. in the column at which temperature the material has a viscosity of about 2.4 poises (measured at 100° C.). A pump preferably continuously circulates the liquid molten wax through the column. Temperatures up to 200° C. and above have also been employed.

Any polyalkylene glycol can be used herein which meets the necessary Reynolds Number values. While polyethylene glycols are preferred, it is contemplated that polypropylene glycols, polybutylene glycols, and the like may be suitably used. Mixtures of glycols as well as mixtures, such as aqueous mixtures, may be employed.

Examples of glycols include (poly)ethylene glycols, methyl or ethyl ether derivatives of the (poly)ethylene glycol such as ethylene glycol monomethyl ether, ethylene glycol monoethyl ether, ethylene glycol dimethyl ether, (poly)propylene glycol, methyl or ethyl ether derivatives of (poly)propylene glycol, such as propylene glycol monomethyl ether or propylene glycol monomethyl ether; and so forth.

Other suitable materials include oils such as Multitherm IG-2 heat transfer fluid sold by Multitherm Corporation, Colywyn, Pa. This material has a viscosity of about 0.05 poises and a specific gravity of about 0.82 at 100° C. Other suitable materials are selected from the group consisting of corn syrup, hydrocarbons, glycerols, paraffin waxes, waxes, oils such as corn oil, soybean oil, etc., sugar solutions, SAIB and the like and mixtures thereof.

At the bottom of the column, the solid shot are removed into a reservoir where they are separated from the wax or other liquid medium and the liquid preferably recycled back to the shotting column. In a preferred procedure, the liquid is introduced into the column near the middle with some of the liquid overflowing at the top and being recycled to the column. This provides a countercurrent flow of liquid and bismuth at the top end of the column and a concurrent flow of liquid and bismuth at the lower end of the column which provides processing advantages for certain applications.

The Reynolds Numbers and Eötvös Numbers may be correlated for certain applications. Thus, at Eötvös Numbers less than about 0.5, the Reynolds Numbers may range from 0.01 to 100. At Eötvös Numbers between about 0.5 and 10 the Reynolds Number varies in an inverse logarithmic relationship so that at an Eötvös Number of about 0.5, the Reynolds Number may be up to about 100, whereas at an E ötvös Number of about 10, the Reynolds Number is preferably less than about 2. At Eötvös Numbers between about 10 and 1000, the Reynolds Numbers are preferably less than about 1.

A number of references discuss the relationship of fluids in motion in terms of dimensionless groups such as the Reynolds Number and Eötvös Number: *Handbook of Fluids in Motion*, edited by N. P. Cheremisinoff and R. Gupta, Ann Arbor Science, Chapter 38, pages 1003–1025; *Shape of Liquid Drops Moving in Liquid Media*, R. M. Wellek, A. K. Agrawal and A. H. P. Shellard, A. I. Ch. E. Journal, September 1966, pages 854–862; *Shapes and Velocities of Single Drops and Bubbles Moving Freely Through Immissible Liquids*, J. R. Grace, T. Wairegi and T. H. Nguyen, Trans. Instn. Chem. Engrs, Vol. 54, 1976, pages 167–173; *and Shapes and Velocities of Bubbles Rising in Infinite Liquids*, J. R. Grace, Trans. Instn. Chem. Engrs., Vol 51, 1973, pages 116–120.

It is not known why correlations from liquid-liquid systems would generally apply to the subject molten liquid to solid—liquid system however, it is theorized that the low degree of superheat in the molten bismuth results in the formation of the desired shape particle before any adverse effects of solidification in a transitional environment are realized. In any event, correlating the degree of superheat with the Reynolds Number and, preferably, with the Eötv ös Number, provides a process useful for preparing bismuth shot suitable for use in shotgun shells and other applications.

As will be appreciated by those skilled in the art, control of the process parameter can produce shot varying from essentially spherical to spherical. It is contemplated herein that essentially spherical shot may be formed into spherical shot using such techniques as grinding, ball milling, etc.

The invention is further illustrated by the following examples, which are not intended to be limiting.

EXAMPLE 1

A bismuth alloy containing nominally, by weight, about 98% bismuth, 2% tin, 100 ppm silver and the balance incidental impurities was melted and heated to a temperature of about 325° C.—which is about 60° C. above the melting point of the alloy. The molten alloy was added to a cup situated above the shotting column which was Pyrex glass 6 inches in diameter by 13 feet high. The cup had six nozzles to produce drops of 0.10 inch to 0.175 inch in diameter in which the drops fell about 0.5 inch before reaching the liquid. The column was filled with Dow Chemical E4500 polyethylene glycol having approximately a melting point of 58° C., a specific gravity of 1.224 at 25° C., and a viscosity of 2.1 poise at 100° C. The glycol was heated and maintained at a temperature of about 80°–100° C. during the test. A positive displacement pump continuously circulated the glycol through the column and a reservoir with the glycol being added at the middle of the column with some of the liquid overflowing at the top and being recycled. A resistance heater was used to maintain the glycol temperature. Estimated Reynolds and Eötvös Numbers were 7 and 4, respectively.

As the molten bismuth alloy fell through the glycol, the metal drops formed into essentially spherical particles. The solid particles collected at the bottom of the column and were transferred through a pipe to a reservoir which had a perforated bottom to separate the glycol from the shot particles. The glycol was recycled to the column and the shot were washed in hot water, dried and sized using a SWECO screen.

The shot were essentially spherical and grinding of the shot removed any imperfections and produced substantially spherical shot suitable for use in shotgun shells.

EXAMPLE 2

The bismuth alloy of EXAMPLE 1 was melted and heated to temperatures as shown in the Table. The molten alloy was added to a cup situated above a shotting column which column was 3 inches in diameter by 4 feet high. The head space between the cup and top of the liquid was about 1 inch. Dow Chemical E8000 polyethylene glycol was used in the column. This material has approximately a molecular weight of 8000, a freezing point of 60° C., a viscosity of 8.8 poises at 100° C. and a specific gravity of 1.224 at 25° C. The temperature of the glycol in the column was maintained at the indicated temperature for each run.

The molten alloy dripped through different sized orifices between 0.07 inch and 0.11 inch in diameter depending on the cup used and formed drops which fell through the column. A ball valve at the bottom of the column was opened intermittently to empty the column of shot. These were batch-type runs.

| RUN | GLYCOL TEMPERATURE (°C.) | METAL TEMPERATURE (°C.) |
|---|---|---|
| 1 | 110 | 300 |
| 2 | 120 | 300 |
| 3 | 140 | 300 |
| 4 | 160 | 300 |
| 5 | 180 | 300 |
| 6 | 200 | 300 |
| 7 | 160 | 310 |
| 8 | 160 | 325 |
| 9 | 160 | 350 |
| 10 | 160 | 325 |
| 11 | 160 | 325 |
| 12 | 160 | 325 |
| 13 | 160 | 325 |

All the runs produced essentially spherical shot. Reynolds Numbers are estimated to be less than 50 for the higher temperature runs to about 1–5 for Run 1. Eötvös Numbers are estimated to be about 4.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A method for producing essentially spherical and/or spherical bismuth or bismuth alloy particles comprising:

melting the bismuth material to a temperature less than about 100° C. above the melting point of the bismuth material;

introducing the molten bismuth material as drops into a vessel containing a liquid material with the height of the vessel being sufficient to allow the drops to solidify to their final stage before reaching the bottom of the vessel;

controlling the method to provide a Reynolds Number (Re) less than about 100 as defined by:

$$Re = \frac{\rho_c d_e U_D}{\mu_c}$$

wherein $\rho_c$=density of the liquid medium in the column;

$d_e$=volume-equivalent drop diameter;

$U_D$=terminal velocity of the drop; and $\mu_c$=viscosity of liquid medium in the column; and removing the solidified bismuth from the vessel.

2. The method of claim 1 wherein the bismuth material is melted to a temperature less than about 50° C. above the melting point of the bismuth material.

3. The method of claim 1 wherein the bismuth material is melted to a temperature less than about 25° C. above the melting point of the bismuth material.

4. The method of claim 1 wherein the bismuth material is melted to a temperature less than about 10° C. above the melting point of the bismuth material.

5. The method of claim 1 wherein the Reynolds Number is less than about 10.

6. The method of claim 1 wherein the Reynolds Number is less than about 1.

7. The method of claim 1 wherein the vessel is a column.

8. The method of claim 1 wherein the method is controlled to provide an Eötvös Number in the range of about 0.01 to 1000.

9. The method of claim 1 wherein the method is controlled to provide an Eötvös Number in the range of about 0.1 to 100.

10. The method of claim 1 wherein the method is controlled to provide a Reynolds Number from about 0.01 to 100 and the Eötvös Number is less than about 0.5.

11. The method of claim 1 wherein the method is controlled to provide a Reynolds Number less than about 1 and the Eötvös is from about 10 to 1000.

12. The method of claim 1 wherein the method is controlled to provide an Eötvös Number from about 0.5 to 10 and the Reynolds Number is correlated in an inverse logarithmic relationship with a value up to about 100.

13. A method for producing essential spherical and/or spherical bismuth and bismuth alloy particles comprising:

melting the bismuth material to a temperature less than about 100° C. above the melting point of the bismuth material;

introducing the molten bismuth material as drops into a vessel containing a material which is liquid at the vessel temperature and is selected from the group consisting of oils, hydrocarbons, corn syrup, glycerols, polyalkylene glycols, and mixtures thereof with the height of the vessel being sufficient to allow the drops to solidify to their final shape before reaching the bottom of the vessel;

controlling the method to provide a Reynolds Number (Re) less than about 100 as defined by:

$$Re = \frac{\rho_c d_e U_D}{\mu_c}$$

wherein $\rho_c$=density of the liquid medium in the column;

$d_e$=volume-equivalent drop diameter;

$U_D$=terminal velocity of the drop; and $\mu_c$=viscosity of liquid medium in the column; and removing the solidified bismuth from the vessel.

14. The method of claim 13 wherein the bismuth material is melted to a temperature less than about 50° C. above the melting point of the bismuth material.

15. The method of claim 13 wherein the material in the vessel is a polyalkylene glycol.

16. The method of claim 15 wherein the polyalkylene glycol is polyethylene glycol which is a solid at room temperature and has a molecular weight of about 4500–8000.

17. The method of claim 16 wherein the glycol is maintained at a temperature up to about 200° C.

18. The method of claim 17 wherein the glycol temperature is about 80° C.–100° C.

19. A method for producing essentially spherical and/or spherical bismuth and bismuth alloy particles comprising:

melting the bismuth material to a temperature less than about 100° C. above the melting point of the bismuth material;

introducing the molten bismuth material as drops into a vessel containing a polyethylene glycol having a molecular weight of about 4500–8000 which is maintained at a temperature up to about 200° C.;

the height of the vessel being sufficient to allow the drops to solidify to their final shape before reaching the bottom of the vessel; and removing the solidified bismuth from the vessel.

20. The method of claim 19 wherein the glycol temperature is maintained at a value of about 80° C.–100° C.

21. The method of claim 19 wherein the material has molecular weight of about 4500.

22. The method of claim 19 wherein the material has a molecular weight of about 8000.

* * * * *

UNITED STATES PATENT AND TRADEMARK OFFICE

CERTIFICATE OF CORRECTION

PATENT NO. : 5,540,749

DATED : July 30, 1996

INVENTOR(S) : Taie Li, David E. Sanger and Duane M. Yantorno

It is certified that error appears in the above-identified patent and that said Letters Patent is hereby corrected as shown below:

Column 3, line 10, the formula should read as follows:

$$E_o = \frac{\Delta pgde}{\sigma}$$

Signed and Sealed this

Nineteenth Day of November, 1996

Bruce Lehman

*Attest:*

BRUCE LEHMAN

*Attesting Officer*

*Commissioner of Patents and Trademarks*